US009578975B2

(12) United States Patent
Rawls-Meehan et al.

(10) Patent No.: US 9,578,975 B2
(45) Date of Patent: Feb. 28, 2017

(54) ADJUSTABLE BED WITH FRICTION MATTRESS MOUNT

(71) Applicant: ASCION, LLC, Bloomfield Hills, MI (US)

(72) Inventors: Martin B. Rawls-Meehan, Franklin, MI (US); Andrew Z. Gong, Waterford, MI (US); Leandro Vera, West Bloomfield, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 0 days.

(21) Appl. No.: 15/078,075

(22) Filed: Mar. 23, 2016

(65) Prior Publication Data

US 2016/0278534 A1 Sep. 29, 2016

Related U.S. Application Data

(60) Provisional application No. 62/136,999, filed on Mar. 23, 2015.

(51) Int. Cl.
*A47C 21/06* (2006.01)
*A47C 21/02* (2006.01)
*A47C 20/04* (2006.01)

(52) U.S. Cl.
CPC ..... *A47C 21/026* (2013.01); *A47C 20/04* (2013.01)

(58) Field of Classification Search
CPC ..... A47C 21/06
USPC ..... 5/420, 613, 925
See application file for complete search history.

(56) References Cited

U.S. PATENT DOCUMENTS 3,242,507 A * 3/1966 Peterson ..... A47C 21/026 5/246
7,321,811 B1 1/2008 Rawls-Meehan
7,465,280 B2 12/2008 Rawls-Meehan
7,805,785 B2 10/2010 Rawls-Meehan
7,930,783 B2 4/2011 Rawls-Meehan
7,933,669 B2 4/2011 Rawls-Meehan
7,979,169 B2 7/2011 Rawls-Meehan
8,019,486 B2 9/2011 Rawls-Meehan
8,032,263 B2 10/2011 Rawls-Meehan
8,032,960 B2 10/2011 Rawls-Meehan
8,046,114 B2 10/2011 Rawls-Meehan
8,046,115 B2 10/2011 Rawls-Meehan
8,046,116 B2 10/2011 Rawls-Meehan
8,046,117 B2 10/2011 Rawls-Meehan
8,050,805 B2 11/2011 Rawls-Meehan
8,069,512 B2 12/2011 Rawls-Meehan
8,078,336 B2 12/2011 Rawls-Meehan
8,078,337 B2 12/2011 Rawls-Meehan
8,150,562 B2 4/2012 Rawls-Meehan
8,375,488 B2 2/2013 Rawls-Meehan
(Continued)

*Primary Examiner* — Fredrick Conley
(74) *Attorney, Agent, or Firm* — Marshall, Gerstein & Borun LLP

(57) ABSTRACT

The disclosure generally relates to an adjustable bed, in particular incorporating a friction mattress mount. In various embodiments, an adjustable bed foundation can include friction-enhancing materials mounted on a deck support surface. The friction-enhancing materials maintain the mattress in a desired position and alignment with respect to the adjustable bed foundation, in particular when adjustable bed foundation is adjusted between various articulated positions (e.g., flat, inclined, and/or declined).

21 Claims, 7 Drawing Sheets

(56) References Cited

U.S. PATENT DOCUMENTS

| | | | | |
|---|---|---|---|---|
| 8,565,934 | B2 | 10/2013 | Rawls-Meehan | |
| 8,682,457 | B2 | 3/2014 | Rawls-Meehan | |
| 2012/0057685 | A1 | 3/2012 | Rawls-Meehan | |
| 2012/0240336 | A1 * | 9/2012 | Dandapure ..... | A63B 6/00 5/417 |

* cited by examiner

ADJUSTABLE BED WITH FRICTION MATTRESS MOUNT

CROSS REFERENCE TO RELATED APPLICATION

Priority is claimed to U.S. Provisional Application No. 62/136,999 (filed Mar. 23, 2015), which is incorporated herein by reference in its entirety.

STATEMENT OF GOVERNMENT INTEREST

None.

BACKGROUND OF THE DISCLOSURE

Field of the Disclosure

The disclosure generally relates to an adjustable bed, in particular incorporating a friction mattress mount. In various embodiments, an adjustable bed foundation can include friction-enhancing materials mounted on a deck support surface. The friction-enhancing materials maintain the mattress in a desired position and alignment with respect to the adjustable bed foundation, in particular when adjustable bed foundation is adjusted between various articulated positions (e.g., flat, inclined, and/or declined).

SUMMARY

In one aspect, the disclosure relates to an adjustable bed comprising: (a) a mattress support surface comprising (i) a first deck support section, and (ii) a second deck support section pivotally attached to the first deck support section; (b) a mattress having an outer bottom surface and positioned above the mattress support surface; and (c) a first deck friction-enhancing material disposed on an upper surface of the mattress support surface and in contact with the outer bottom surface of the mattress (e.g., a fabric material such as a non-woven fabric). In an alternative aspect, the disclosure relates to a non-adjustable bed comprising: (a) a fixed mattress support surface; (b) a mattress having an outer bottom surface and positioned above the mattress support surface; and (c) a first deck friction-enhancing material disposed on an upper surface of the mattress support surface and in contact with the outer bottom surface of the mattress (e.g., a fabric material such as a non-woven fabric). The first deck friction-enhancing material and the outer bottom surface of the mattress have an increased coefficient of static friction ($\mu_s$) at a contact interface between the first deck friction-enhancing material and the outer bottom surface of the mattress relative to a corresponding coefficient of static friction between the upper surface of the mattress support surface and the outer bottom surface of the mattress.

In another aspect, the disclosure relates to an adjustable foundation comprising: (a) a mattress support surface comprising (i) a first deck support section, and (ii) a second deck support section pivotally attached to the first deck support section; and (b) a first deck friction-enhancing material disposed on an upper surface of the mattress support surface and positioned to contact an outer bottom surface of a mattress positioned above the mattress support surface, when the mattress is present. In an alternative aspect, the disclosure relates to a non-adjustable foundation comprising: (a) a fixed mattress support surface; and (b) a first deck friction-enhancing material disposed on an upper surface of the mattress support surface and positioned to contact an outer bottom surface of a mattress positioned above the mattress support surface, when the mattress is present. The first deck friction-enhancing material and the outer bottom surface of the mattress, when the mattress is present, have an increased coefficient of static friction ($\mu_s$) at a contact interface between therebetween relative to a corresponding coefficient of static friction between the upper surface of the mattress support surface and the outer bottom surface of the mattress, when the mattress is present.

Various refinements of the adjustable or non-adjustable bed and foundation are possible.

In a refinement, the coefficient of static friction ($\mu_s$) at the contact interface between the first deck friction-enhancing material and the outer bottom surface of the mattress is at least 0.5.

In another refinement, the first deck friction-enhancing material comprises a polymer material selected from the group consisting of a thermoset elastomer and a thermoplastic elastomer. In various embodiments, the first deck friction-enhancing material comprises a thermoplastic elastomer selected from the group consisting of thermoplastic styrenic block copolymers, thermoplastic polyolefin blends, thermoplastic polyolefin copolymers, thermoplastic elastomeric alloys, thermoplastic polyurethanes, thermoplastic copolyesters, and thermoplastic polyamides.

In another refinement, the first deck friction-enhancing material laterally extends a substantial portion of the mattress support surface width, for example laterally extending at least 40% of the mattress support surface width.

In another refinement, the first deck friction-enhancing material has a diamond-shaped orientation relative to a longitudinal direction of the adjustable bed.

In another refinement, (i) the first deck friction-enhancing material is disposed on an upper surface of the first deck section of the mattress support; (ii) the first deck section corresponds to a foot portion of the mattress support surface; and (iii) deck support sections of the mattress support other than the first deck section are free from friction-enhancing materials disposed thereon.

In another refinement, (i) the first deck friction-enhancing material is disposed on an upper surface of the first deck section of the mattress support; (ii) the first deck section corresponds to a foot portion of the mattress support surface; (iii) the adjustable bed further comprises a second deck friction-enhancing material disposed on an upper surface of the second deck section of the mattress support; (iv) the second deck section corresponds to a leg portion of the mattress support surface; and (v) deck support sections of the mattress support other than the first and second deck sections are free from friction-enhancing materials disposed thereon.

In another refinement, (i) the first deck friction-enhancing material is disposed on an upper surface of the first deck section of the mattress support; (ii) the first deck section corresponds to a foot portion of the mattress support surface; and (iii) deck support sections of the mattress support corresponding to a head portion of the mattress support surface are free from friction-enhancing materials disposed thereon.

In another refinement, (i) the first deck friction-enhancing material is disposed on an upper surface of the first deck section of the mattress support; (ii) the first deck section corresponds to a foot portion of the mattress support surface; (iii) the adjustable bed further comprises a second deck friction-enhancing material disposed on an upper surface of the second deck section of the mattress support; (iv) the second deck section corresponds to a leg portion of the mattress support surface; and (v) deck support sections of the mattress support corresponding to a head portion of the mattress support surface are free from friction-enhancing materials disposed thereon.

In another refinement, the adjustable bed further comprises (d) a first mattress friction-enhancing material disposed on the outer bottom surface of the mattress and positioned in a complementary position relative to the first deck friction-enhancing material and in contact therewith; wherein the first deck friction-enhancing material and the first mattress friction-enhancing material have an increased coefficient of static friction ($\mu_s$) at a contact interface between the first deck friction-enhancing material and the first mattress friction-enhancing material relative to a corresponding coefficient of static friction between the upper surface of the mattress support surface and the outer bottom surface of the mattress. In a further refinement, the first mattress friction-enhancing material laterally extends a substantial portion of the mattress width, for example laterally extending at least 40% of the mattress width. In a further refinement, the first mattress friction-enhancing material has a diamond-shaped orientation relative to a longitudinal direction of the adjustable bed. In a further refinement, the coefficient of static friction ($\mu_s$) at the contact interface between the first deck friction-enhancing material and the first mattress friction-enhancing material is at least 0.5. In a further refinement, the first mattress friction-enhancing material comprises a polymer material selected from the group consisting of a thermoset elastomer and a thermoplastic elastomer (e.g., the same or different material from that of the first deck friction-enhancing material).

In another refinement, the adjustable bed is free from mattress retainer bars.

In another refinement, the mattress support surface further comprises (iii) a third deck support section pivotally attached to the second deck support section, and (iv) optionally a fourth deck support section pivotally attached to the third deck support section.

In another aspect, the disclosure relates to method for adjusting an adjustable bed, the method comprising: (a) providing an adjustable bed according to the disclosure in any of its various embodiments; and (b) articulating the adjustable bed from a first position to a second position, wherein: (i) the mattress support surface in the second position is other than a flat configuration; and (ii) the mattress remains substantially in contact with the mattress support surface in the first position and the second position.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to an adjustable bed, in particular incorporating a friction mattress mount. In various embodiments, an adjustable bed foundation and (optionally) a mattress of an adjustable bed each can include friction-enhancing materials such that they provide an increased frictional resistance to longitudinal (and lateral) slipping of the mattress. The friction-enhancing materials, which are suitably located in a foot region and (optionally) in a leg region of the adjustable bed, maintain the mattress in a desired position and alignment with respect to the adjustable bed foundation, in particular when adjustable bed foundation is adjusted between various articulated positions (e.g., flat, inclined, and/or declined). The friction-enhancing materials provide a non-invasive mounting means that can be incorporated onto an outer surface of adjustable bed foundation (e.g., a deck support surface thereof) and (optionally) onto an outer surface of essentially any mattress (e.g., conventional mattress, foam-based mattress such as including foam cylinders), and they can be used as an alternative to mechanical mattress mounting/stabilizing structures (e.g., frame/mattress mounting brackets and the like, which can be also included in or completely absent from the adjustable bed).

Figure 1:
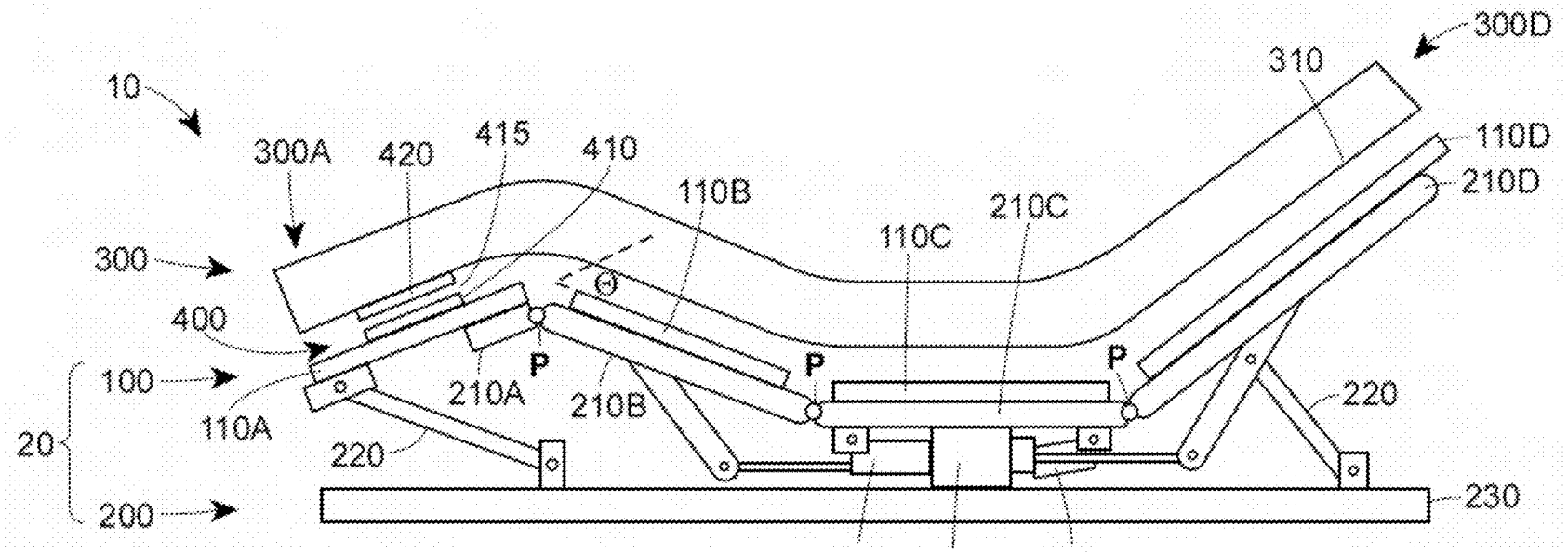
FIG. 1 is a side view of an adjustable bed including an adjustable foundation and a friction-mounted mattress according to the disclosure.
Figure 2:
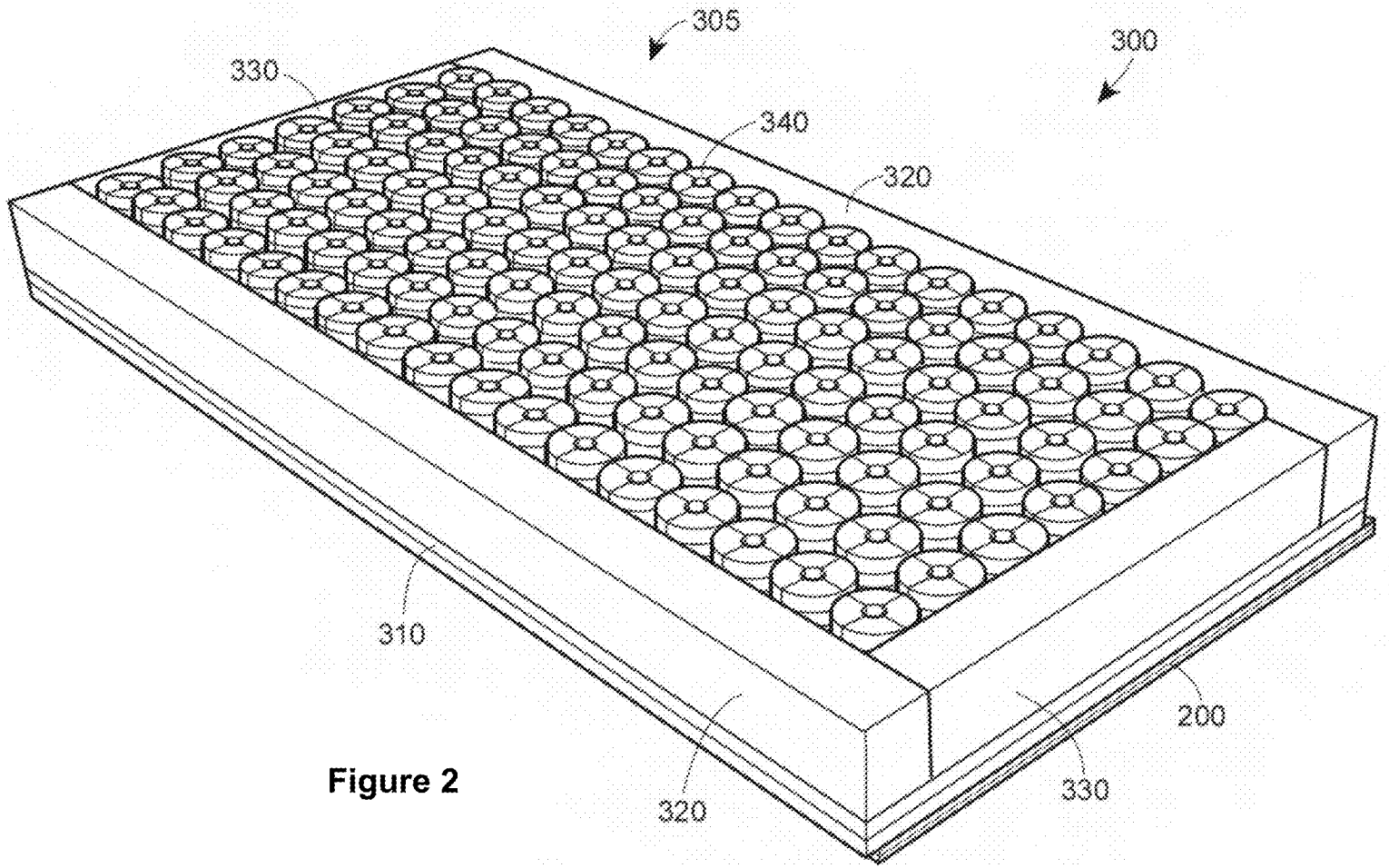
FIG. 2 is a top perspective illustration of a mattress according to the disclosure.
Figure 3:
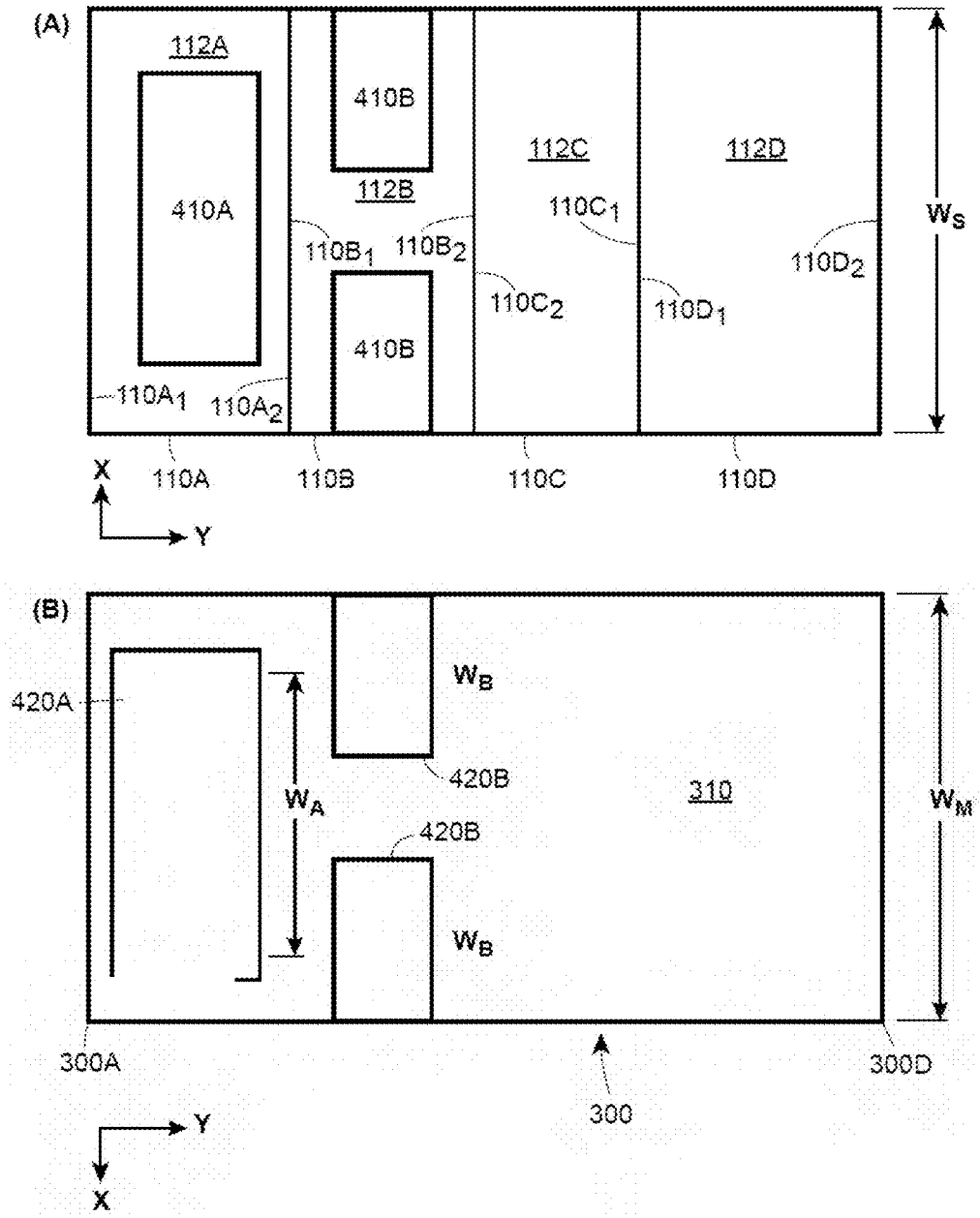
FIG. 3 includes a top view (A) of an adjustable foundation and a bottom view (B) of a mattress including friction mounting materials according to the disclosure.
Figure 4:
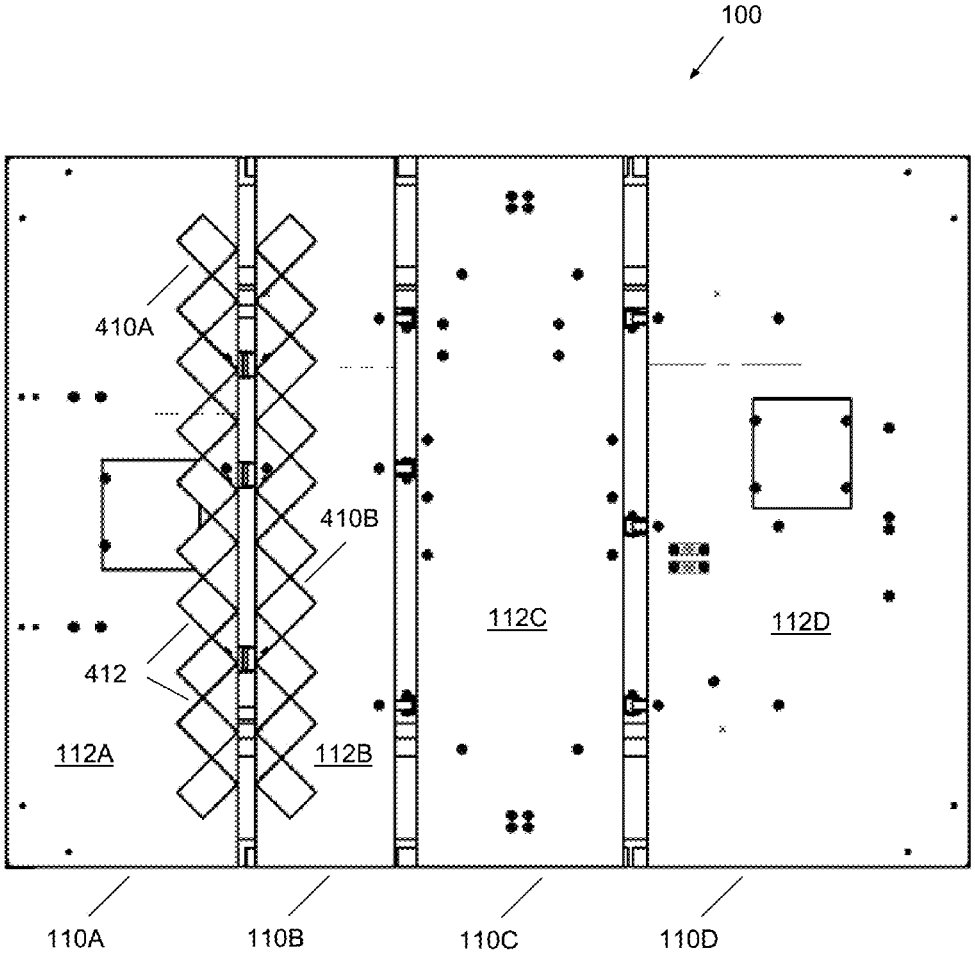
FIG. 4 is a top view of an adjustable foundation including friction mounting materials according to the disclosure.

FIG. 1 is a side view of an adjustable bed 10 according to the disclosure. The illustrated adjustable bed 10 includes an adjustable foundation 20 (e.g., adjustable bed foundation), a mattress 300 sitting atop the adjustable foundation 20, and a friction mattress alignment system 400 (e.g., including a deck friction-enhancing material 410 and optionally a mattress friction-enhancing material 420 positioned at one or more locations on the foundation 20 and (optionally) the mattress 300). The adjustable foundation 20 can include a mattress support (or deck) 100 mounted to an adjustable frame 200. FIG. 2 is a top perspective illustration of a mattress 300 according to the disclosure. FIG. 3 includes a top view (A) the an adjustable foundation 20 and a bottom view (B) of the mattress 300 including friction-enhancing mounting materials 410, 420 according to the disclosure. FIG. 4 is a top view of an adjustable foundation 20 including friction mounting materials 410 according to the disclosure.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 1100$_1$ and 1100$_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a first (foot) support section 110A, a second (leg) support section 110B pivotally attached to the first section 110A, a third (bottom) support section 110C pivotally attached to the second section 110B, and a fourth (head/neck) support section 110D pivotally attached to the third section 110C as shown in FIG. 1. In other embodiments (not shown), the mattress support 100 can have fewer or more support sections (e.g., a first (foot) support section, a second (leg and bottom) support section pivotally attached thereto, and a third (head/neck) support section pivotally attached thereto). In some embodiments the support sections 110A-110D can be formed from a rigid support material such as wood or metal. In other embodiments the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

As illustrated, the adjustable frame 200 further includes a subframe 230, for example a rigid, non-articulatable frame structure which sits on a floor or within a decorative bed frame common in the furniture industry such as a platform bed (e.g., via various leg elements, not shown) and provides stability for the bed foundation 20 as the adjustable frame 200 is articulated to various different positions. The adjustable frame 200 can further include one or more support members 220 connecting structure between the subframe 230 and the frame support 210 and sections 210A-210D thereof. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include one or more actuators 240 variously mounted to one or more of the subframe 230, a support member 220, and a frame support section 210A-210D. In some embodiments, the subframe 230, the support members 220, and the frame support sections 210A-210D can be formed from metal such as steel. The actuators 240 can be any of those commonly known in the art. The actuators 240 and, correspondingly, the configuration or position of the adjustable frame 200, mattress support 100, and mattress 300 can be controlled and adjusted by a suitable power supply (not shown), adjustable bed controller (not shown; e.g., programmable logic controller or otherwise), and remote control to deliver repositioning commands (not shown).

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. In the illustrated embodiment, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material (e.g., a non-woven fabric material). The mattress 300 is generally positioned above the mattress support 100 surface 112, for example sitting directly atop the deck support sections 110A-110D. In other embodiments, other structure between the mattress 300 and mattress support 100 surface 112 can be present, for example a padding or cushion material (e.g., which can be continuous or include openings where corresponding friction-enhancing materials 410, 420 are positioned on the mattress 300 and mattress support 100.

The friction mattress alignment system 400 generally includes a first deck friction-enhancing material 410 located on an upper surface 112 of the mattress support 100, which contacts an outer bottom surface 310 of the mattress 300. In some embodiments, the system 400 further includes a first mattress friction-enhancing material 420 located on the outer bottom surface 310 of the mattress 300 and positioned in a complementary position to the first deck friction-enhancing material 410 (e.g., friction-enhancing materials 410, 420 having generally overlapping areas, although they need not have the exact same surface areas or contact areas). In embodiments without the mattress friction-enhancing material 420, the first deck friction-enhancing material 410 and the outer bottom surface 310 of the mattress 300 have an increased coefficient of static friction ($\mu_s$) at a contact interface 415 between the first deck friction-enhancing material 410 and the outer bottom surface of the mattress 300 relative to a corresponding coefficient of static friction between the upper surface 112 of the mattress support surface 110 and the outer bottom 310 surface of the mattress 300. In embodiments with the mattress friction-enhancing material 420, the first deck friction-enhancing material 410 and the first mattress friction-enhancing material 420 have an increased coefficient of static friction ($\mu_s$) at a contact interface 415 between the first deck friction-enhancing material 410 and the first mattress friction-enhancing material 420 relative to a corresponding coefficient of static friction between the upper surface 112 of the mattress support surface 110 and the outer bottom surface 310 of the mattress 300. In either embodiment, the increased coefficient of static friction (e.g., at least 0.5 or 1 and/or up to 1.5 or 2) limits or prevents slippage or movement in the longitudinal direction Y and/or the lateral direction X, in particular when the adjustable foundation 20 is articulated between various different positions.

In some embodiments, the friction-enhancing materials 410, 420 in a complementary paring can be in contact with each other when the mattress 300 sits atop the mattress support 100. As illustrated in FIG. 3, for example, the deck friction-enhancing material 410A directly contacts the mattress friction-enhancing material 420A, and the deck friction-enhancing materials 410B directly contact the mattress friction-enhancing materials 420B (i.e., when the mattress 300 is on the mattress support 100). As further illustrated, the friction-enhancing materials 410A, 420A each can be a single piece of friction-enhancing material (e.g., centrally located across the width direction), while the friction-enhancing materials 410B, 420B each can include two pieces of friction-enhancing material (e.g., laterally spaced apart and positioned at or near the lateral edge of their respective mounting surface). In some embodiments (not shown), the two-piece (or multi-piece) friction-enhancing materials 410B, 420B can be laterally spaced apart and positioned at or near the lateral edge of the foot support section 110A and/or foot end 300A of the mattress 300 (e.g., and also position at the longitudinal end of the foot support section 110A and mattress 300, such as in the foot corner regions of the mounting surfaces). In other refinements (not shown), the head section 110D and/or head end 300D of the mattress 300 can be free of friction-enhancing materials, include single-piece friction-enhancing materials, or include two-piece (or multi-piece) friction-enhancing materials laterally spaced apart and positioned at or near the lateral edge and/or longitudinal end of the mounting surfaces.

In some embodiments, the deck friction-enhancing material 410 laterally extends a substantial portion of the mattress support 100 surface 112 width $W_S$, and the mattress friction-enhancing material 420 (when present) laterally extends a substantial portion of the mattress 300 width $W_M$ (e.g., which can be the same or substantially the same as $W_S$). For example, the deck friction-enhancing material 410 can laterally extend at least 40%, 50%, 60%, 80%, or 90% and/or up 50%, 60%, 80%, 90% or 100% of the width $W_S$, and/or the mattress friction-enhancing material 420 can laterally extend at least 40%, 50%, 60%, 80%, or 90% and/or up 50%, 60%, 80%, 90% or 100% of the width $W_M$. Lateral extension and width are generally defined as parallel to the pivot axis P or, equivalently, perpendicular to the major length direction of the mattress 300 and mattress support 100 (e.g., in the local lateral direction X and perpendicular to the local longitudinal direction Y). Such lateral extension of the friction-enhancing materials 410, 420 creates an additional resistance to off-longitudinal axis Y twisting force or torque applied to the mattress 300 (e.g., when occupants on the mattress 300 create an asymmetric load thereon during bed 10 articulation), thus maintaining the mattress 300 properly laterally aligned on the mattress support 100 surface 122, in addition to preventing longitudinal sliding motion. Lateral extent can refer to the total lateral length of the friction-enhancing material, whether present as a single continuous piece of friction-enhancing material or as multiple, spaced-apart pieces of friction-enhancing material. For example, as illustrated in FIG. 3, the friction-enhancing material 420A is a single piece with width $W_A$, so the lateral extent is also $W_A$, and the friction-enhancing material 420A spans a fraction $W_A/W_M$ of the mattress 300. Similarly, the friction-enhancing material 420B includes two pieces with the same width $W_B$ (although they could be different in length), so the lateral extent is $2W_B$, and the friction-enhancing material 420B spans a fraction $2W_B/W_M$ of the mattress 300. For instance, a single 36-inch (91.4 cm) wide friction-enhancing strip can be used to span about 62% of a 58-inch (147 cm) wide queen size mattress or mattress support, and two of the 36-inch (91.4 cm) wide friction-enhancing strips can be used to span about 96% of a 74.8-inch (190 cm) wide king size mattress or mattress support (e.g., in a split-king configuration with two side-by-side twin mattresses (37.4 inch or 95 cm), each with its own laterally aligned friction-enhancing strip). In other embodiments, lateral extent can refer to the lateral distance separating the two furthest friction-enhancing surfaces.

In various embodiments, the friction-enhancing materials 410, 420 are suitably positioned in a foot section (or foot and leg sections) of the mattress 300 (e.g., at or near a foot end 300A as opposed to a head end 300D) or in a foot deck support section (or foot and leg deck support sections) of the mattress support 100 (e.g., in deck support section 110A). Placement of friction-enhancing materials 410, 420 in the foot and/or leg regions of the adjustable bed 10 is advantageous because articulation of the foot and/or leg sections 110A, 110B, 210A, 210B of the adjustable foundation 20 tends to create shearing forces (e.g., in the local longitudinal direction Y and/or local lateral direction X) between the mattress 300 and the adjustable foundation 20, but minimal or no normal forces (e.g., in the local normal direction Z). The friction-enhancing materials 410, 420 resist the shearing forces and maintain the mattress 300 in proper alignment without vertical/normal separation or lift-off of the mattress 300 from the foundation 20. In contrast, friction-enhancing materials 410, 420 placed in other regions of the bed 10 might provide less stabilizing effect, for example when bed 10 articulation in the region generates normal or lift-off forces, in particular with a relatively rigid mattress 300 (e.g., a conventional spring or coil mattress). In some embodiments, deck support sections of the mattress support corresponding to a head portion of the mattress support surface and the mattress are free from friction-enhancing materials disposed thereon (e.g., and a corresponding head region of the mattress is also free from friction-enhancing materials).

For example, as illustrated in FIG. 3, the deck support section 110D and the corresponding head end 300D of the mattress 300 are free from friction-enhancing materials (e.g., although sections such as the leg section 110B other than the foot section 110A can include friction-enhancing materials). In other embodiments, deck support sections of the mattress support other than the foot and/or leg deck section are free from friction-enhancing materials disposed thereon (e.g., and only a corresponding foot and/or leg region of the mattress incudes friction-enhancing materials disposed thereon, when present). For example, the friction-enhancing materials 410B, 420B could be removed from the illustrated embodiment of FIG. 3 to include only friction-enhancing materials 410A, 420A in the foot sections of the foundation 20 and optionally the mattress 300.

Figure 5:
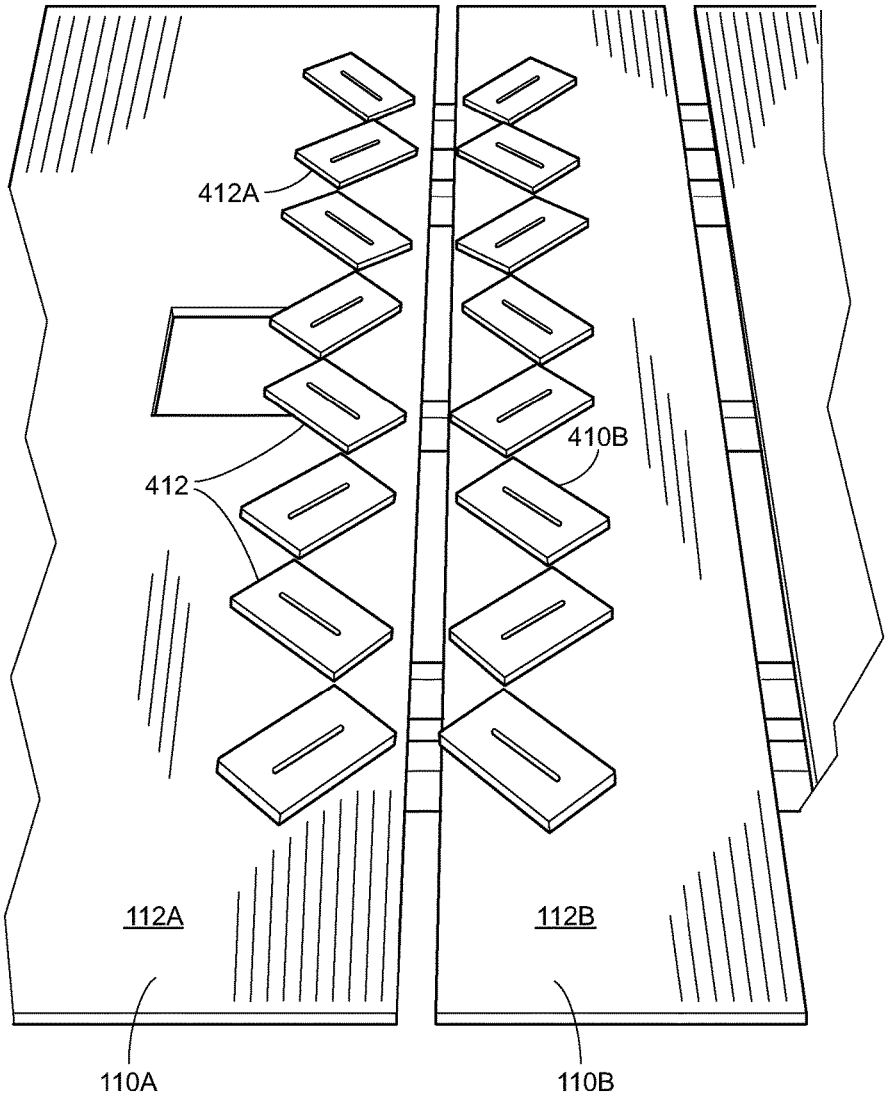
FIG. 5 is a photograph top perspective view of an adjustable foundation including friction mounting materials according to the disclosure.

In an embodiment as illustrated in FIGS. 4-5, the deck friction-enhancing materials 410A, 410B can have a diamond-shaped orientation relative to the longitudinal direction Y of the adjustable bed 10. For example, the friction-enhancing materials 410A, 410B can include a plurality of rectangular friction-enhancing material segments oriented an angle which exposes two edges 412 of a material segment to the longitudinal direction Y of potential slippage for the mattress 300 (e.g., an angle which is neither perpendicular to nor parallel with the longitudinal direction Y). Increasing the exposed linear edge and/or surface area of the material segment in contact with the mattress 300 can increase frictional resistance and reduce or eliminate mattress 300 slippage. Although the friction-enhancing materials 410A, 410B are illustrated in FIG. 4 as a plurality of friction-enhancing material segments, other shapes and configurations of the friction-enhancing material or segments thereof are possible. For example, in other embodiments, the materials 410A, 410B can be in the form of unitary materials that have a diamond shape or otherwise present an increased linear edge of exposed material surface relative to a material with an exposed edge which is perpendicular to the longitudinal direction Y (e.g., a zig-zag shape or other shape presenting linear edges of exposed material surface at non-perpendicular and non-parallel angles relative to the longitudinal direction Y).

The friction-enhancing materials 410, 420 are formed from or otherwise include high-friction materials that prevent or resist sliding or shearing motion when the materials 410, 420 are in contact with each other (e.g., in embodiments including both materials 410, 420) or when the friction-enhancing material 410 is in contact with bottom surface 310 of the mattress 300 (e.g., when the material 410 contacts a fabric or other bottom surface 310 of the mattress 300, such as in embodiments without the material 420). For example, the coefficient of static friction ($\mu_s$) at a contact interface 415 between the materials 410/310 or the materials 410/420 can be at least 0.5, 0.6, 0.7, 0.8, 0.9, or 1.0 and/or up to 1.2, 1.5, or 2 (e.g., or even higher for rough surfaces), for example 0.5 to 2, 0.7 to 1.5, 0.8 to 1.2, or 0.9 to 1.1. Such static friction coefficients can represent relatively high-friction polymer-polymer interfaces and polymer-fabric interfaces (e.g., when the friction-enhancing materials are formed from polymers and contact each other or a fabric surface of a mattress). In some embodiments, high-friction interfaces can be formed using foamed materials (e.g., open- or closed-cell foamed materials, such as formed from polymeric foams) as friction-enhancing materials.

When one or both of the friction-enhancing materials 410, 420 include a polymeric material (e.g., an elastomeric mateal), the polymer material suitably can be a thermoset polymer or a thermoplastic polymer, for example a thermoset elastomer or a thermoplastic elastomer. Generally any thermoset or thermoplastic polymer can be used, in particular those having desirably high-friction surface properties. Elastomeric thermoset or thermoplastic polymers can be particularly suitable, as they have a flexible, rubbery nature that can be useful for the flexible bottom surface of a mattress or a friction-enhancing material that spans a pivot point of an otherwise rigid mattress deck. Example thermoset elastomers include natural polyisoprene (natural rubber) or synthetic polyisoprene (synthetic rubber), polybutadiene, chloroprene, butyl rubber, styrene-butadiene, nitrile rubber, ethylene propylene rubber, ethylene propylene diene rubber. Example thermoplastic elastomers include thermoplastic styrenic block copolymers, thermoplastic polyolefin blends, thermoplastic polyolefin copolymers, thermoplastic elastomeric alloys, thermoplastic polyurethanes, thermoplastic copolyesters, thermoplastic polyamides, and combinations thereof. An example of a suitable thermoplastic polyolefin copolymer for use as a friction-enhancing material includes an ethylene-vinyl acetate copolymer, for example in the form of a foamed material, alone or in combination (e.g., as a foamed blend) with one or more other polymeric materials (e.g., polyurethane). More generally, open- or closed-cell polymeric foamed materials can be used as friction-enhancing materials (e.g., foamed polyurethane). Both opposing friction-enhancing materials 410, 420 can include polymeric materials.

The inclusion of the friction mattress alignment system 400 into an adjustable bed 10 as generally described herein in any of its variously disclosed embodiments is particularly useful in maintaining the mattress 300 in proper alignment and properly seated on the foundation 20 when the bed 10 is articulated. For example, when articulating the adjustable bed 10 from a first position (e.g., flat or non-flat configuration) to a second position other than a flat configuration (e.g., as illustrated in FIG. 1, for instance), the mattress 300 remains substantially in contact with the mattress support 100 surface 112 in the first position and the second position (e.g., in the first position, in the second position, and while transitioning therebetween). For example, at least 70%, 80%, 90%, 95% and/or up to 80%, 90%, 95%, or 100% of the surface area remains contact between mattress 300 and mattress support 100 surface 122 in the first and second positions (e.g., allowing for some mattress separation from the support surface at the support surface section joints, such where the mattress curves but the support surface can have a sharper transition). The mattress 300 can be characterized by a substantial absence of any lift-off of the mattress 300 from the support 100 surface 112, and the corresponding friction-enhancing materials 410, 420 remain in substantial contact in the first and second positions (e.g., at least 90% or 95% and/or up to 95% or 100% contact surface area remains between the friction-enhancing materials, without lift-off or delamination of the friction-enhancing surfaces). In addition to remaining in substantial contact with the foundation 20, the mattress 300 suitably also remains substantially aligned on its mattress support 100 surface 112 in the first and second positions (e.g., longitudinal axes of the mattress 300 and the support 100 surface 112 are within 1°, 2°, 5°, or 10° of each other).

At least one of the first position and the second position can reflect a high degree of articulation. In an embodiment, at least one deck support section 110A-D is angled at least 10°, 20°, 30°, or 45° and/or up to 20°, 30°, 45°, or 60° relative to an adjacent mattress support surface section in the first or second position (e.g., illustrated as angle Θ in FIG. 1). For example, the angle Θ can represent the degree of articulation between the foot section 110A and an adjacent section such as the leg section 110B (or bottom section depending on structure of adjustable frame), the angle Θ can represent the degree of articulation between the head and/or back section 110D and an adjacent section such as the bottom section 110C (e.g., depending on structure of adjustable frame), as well as multiple combinations of adjacent mattress support sections.

Figure 6:
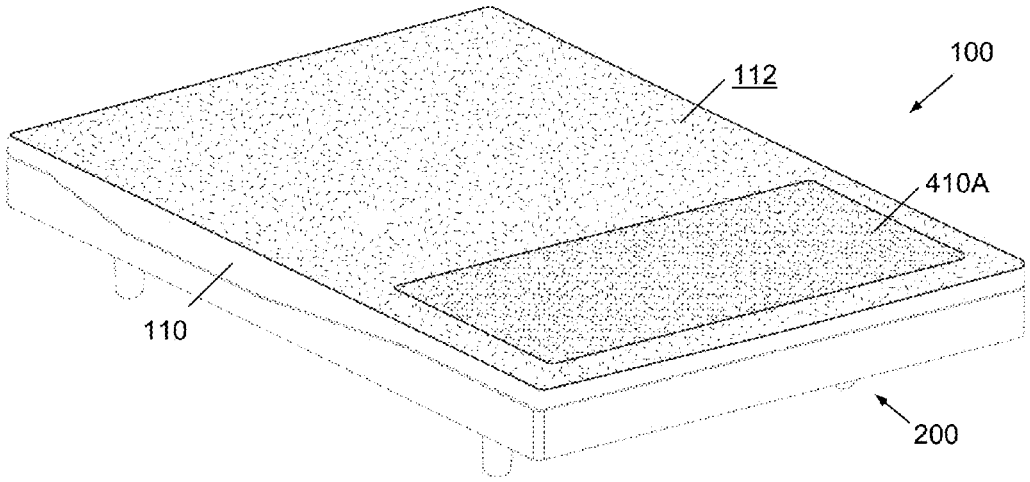
FIG. 6 is a top perspective view of a non-adjustable bed including friction-mounting materials on a mattress support according to the disclosure.
Figure 7:
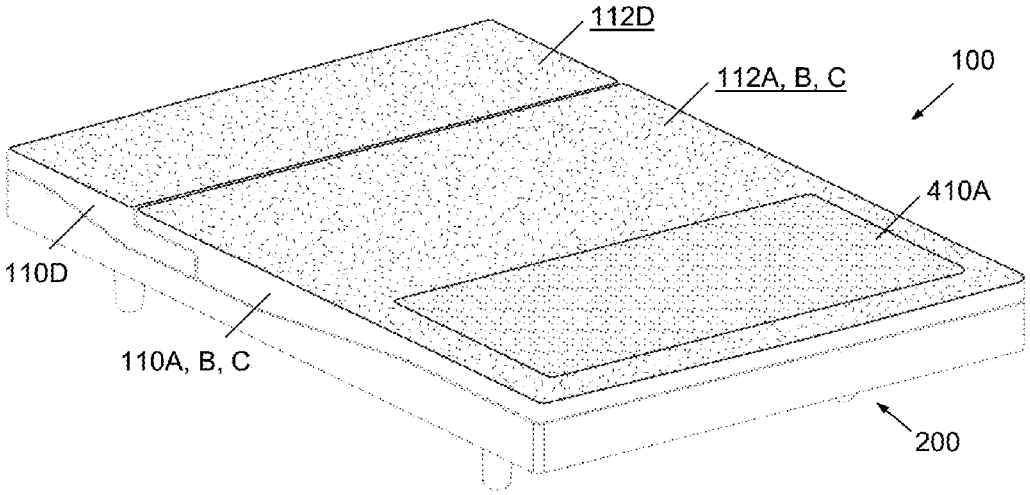
FIG. 7 is a top perspective view of an adjustable bed including friction-mounting materials on a mattress support with an adjustable head support according to the disclosure.
Figure 8:
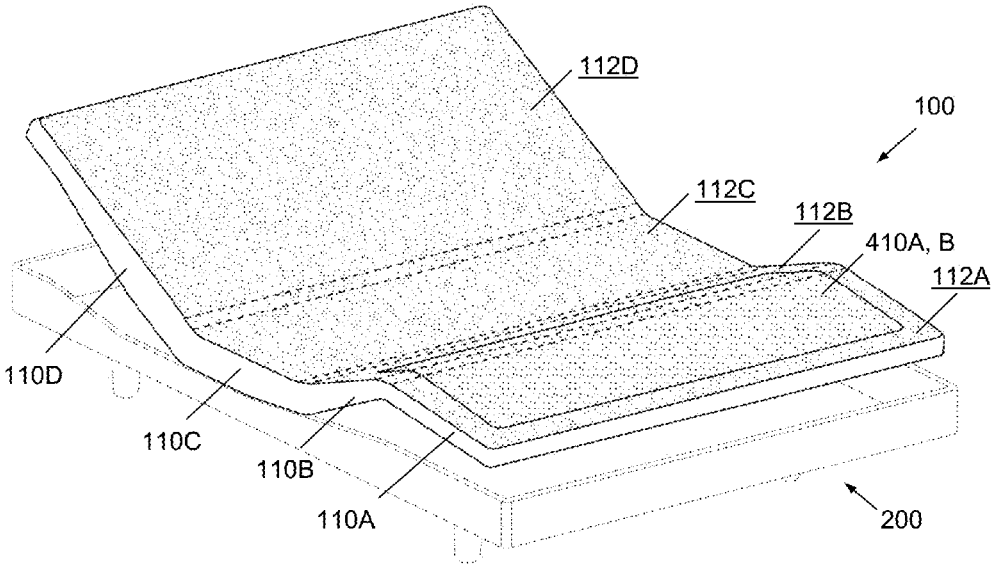
FIG. 8 is a top perspective view of an adjustable bed including friction-mounting materials on a mattress support with adjustable head/back, bottom, leg, and foot supports according to the disclosure.
Figure 9:
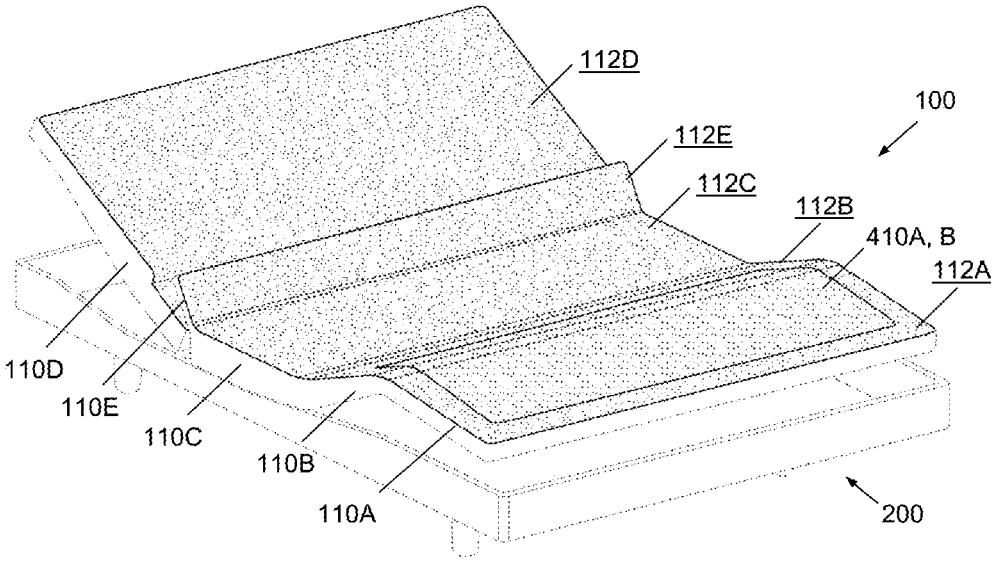
FIG. 9 is a top perspective view of an adjustable bed including friction-mounting materials on a mattress support with adjustable head/back, lumbar, bottom, leg, and foot supports according to the disclosure.

FIGS. 6-9 illustrate various embodiments of non-adjustable and adjustable beds including friction-mounting materials on a mattress support according to the disclosure. FIG. 6 illustrates a non-adjustable bed including a bed frame 200 and a fixed mattress support surface 100 with a deck support 110 having a top surface 112. The friction-enhancing material 410A is located on the top or upper surface 112, generally in the foot region of the mattress support surface 100. FIG. 7 illustrates an adjustable bed including a bed frame 200 and an adjustable mattress support surface 100 with (i) an adjustable head deck support section 110D having a top surface 112D and (ii) a fixed bottom/leg/foot deck support section 110A, B, C having a top surface 112A, B, C. The friction-enhancing material 410A is located on the top or upper surface 112A, B, C, generally in the foot region of the mattress support surface 100. FIG. 8 illustrates an adjustable bed including a bed frame 200 and an adjustable mattress support surface 100 with (i) an adjustable head deck support section 110D having a top surface 112D, (ii) an adjustable bottom deck support section 110C having a top surface 112C, (iii) an adjustable leg deck support section 110B having a top surface 112B, and (iv) an adjustable foot deck support section 110A having a top surface 112A. The friction-enhancing material 410A, B is located on the top or upper surfaces 112A, B primarily in the foot region but also partially in the leg region of the mattress support surface 100. FIG. 9 illustrates an adjustable bed similar to that of FIG. 8, but further including an adjustable lumbar deck support section 110E having a top surface 112E positioned between the head section 110D and the bottom section 110C. As described above, in some embodiments the various deck support sections can be formed from a rigid support material such as wood or metal. In other embodiments the support sections can be formed from a flexible fabric or padding material (e.g., alone or in combination with a rigid support material, such as a cover or padding for an underlying rigid support material, where the cover or padding overlay including the friction-mounting materials attached thereto).

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS LIST

10 adjustable bed (including mattress support 100, adjustable frame 200, mattress 300, and friction system 400)
20 adjustable foundation (including mattress support 100, adjustable frame 200, and deck friction-enhancing material 410)
100 mattress support (or deck) surface
110 deck support (sections 110A-D as foot, leg, bottom, and back/head portions; longitudinally opposed ends 110$A_1$ and 110$A_2$, 110$B_1$ and 110$B_2$, 1100$_1$ and 1100$_2$, 110$D_1$ and 110$D_2$)
112 top surface of deck support (sections 112A-D as for deck support)
200 adjustable (bed) frame
210 frame support (sections 210A-D as for deck support)
220 support member
230 subframe
240 actuator or movement/articulation means
300 mattress (300A: foot end; 300D: head end)
305 containment frame
310 base
320 sidewalls
330 endwalls
340 foam cells or foam springs
400 friction mattress alignment system
410 deck friction-enhancing material
412 leading/contact edge of friction-enhancing material (diamond configuration)
415 contact interface or surface
420 mattress friction-enhancing material
X (local) lateral direction
Y (local) longitudinal direction
Z (local) normal direction
P pivot axis
Θ angle of articulation between adjacent sections

What is claimed is:

1. An adjustable bed comprising:

(a) a mattress support surface comprising (i) a first deck support section, and (ii) a second deck support section pivotally attached to the first deck support section;

(b) a mattress having an outer bottom surface and positioned above the mattress support surface; and (c) a first deck friction-enhancing material fixedly mounted on an upper surface of the mattress support surface and in contact with the outer bottom surface of the mattress;

wherein the first deck friction-enhancing material and the outer bottom surface of the mattress have an increased coefficient of static friction ($\mu_s$) at a contact interface between the first deck friction-enhancing material and the outer bottom surface of the mattress relative to a corresponding coefficient of static friction between the upper surface of the mattress support surface and the outer bottom surface of the mattress.

2. The adjustable bed of claim 1, wherein the coefficient of static friction ($\mu_s$) at the contact interface between the first deck friction-enhancing material and the outer bottom surface of the mattress is at least 0.5.

3. The adjustable bed of claim 1, wherein the first deck friction-enhancing material comprises a polymer material selected from the group consisting of a thermoset elastomer and a thermoplastic elastomer.

4. The adjustable bed of claim 1, wherein the first deck friction-enhancing material comprises a thermoplastic elastomer selected from the group consisting of thermoplastic styrenic block copolymers, thermoplastic polyolefin blends, thermoplastic polyolefin copolymers, thermoplastic elastomeric alloys, thermoplastic polyurethanes, thermoplastic copolyesters, and thermoplastic polyamides.

5. The adjustable bed of claim 1, wherein the first deck friction-enhancing material laterally extends a substantial portion of the mattress support surface width.

6. The adjustable bed of claim 5, wherein the first deck friction-enhancing material laterally extends at least 40% of the mattress support surface width.

7. The adjustable bed of claim 1, wherein the first deck friction-enhancing material has a diamond-shaped orientation relative to a longitudinal direction of the adjustable bed.

8. The adjustable bed of claim 1, wherein (i) the first deck friction-enhancing material is fixedly mounted on an upper surface of the first deck section of the mattress support;

(ii) the first deck section corresponds to a foot portion of the mattress support surface; and (iii) deck support sections of the mattress support other than the first deck section are free from friction-enhancing materials disposed thereon.

9. The adjustable bed of claim 1, wherein (i) the first deck friction-enhancing material is fixedly mounted on an upper surface of the first deck section of the mattress support;

(ii) the first deck section corresponds to a foot portion of the mattress support surface;

(iii) the adjustable bed further comprises a second deck friction-enhancing material fixedly mounted on an upper surface of the second deck section of the mattress support;

(iv) the second deck section corresponds to a leg portion of the mattress support surface;

(v) the mattress support surface further comprises a third deck support section pivotally attached to the second deck support section; and (vi) deck support sections of the mattress support other than the first and second deck sections are free from friction-enhancing materials disposed thereon.

10. The adjustable bed of claim 1, wherein (i) the first deck friction-enhancing material is fixedly mounted on an upper surface of the first deck section of the mattress support;

(ii) the first deck section corresponds to a foot portion of the mattress support surface; and (iii) deck support sections of the mattress support corresponding to a head portion of the mattress support surface are free from friction-enhancing materials disposed thereon.

11. The adjustable bed of claim 1, wherein (i) the first deck friction-enhancing material is fixedly mounted on an upper surface of the first deck section of the mattress support;

(ii) the first deck section corresponds to a foot portion of the mattress support surface;

(iii) the adjustable bed further comprises a second deck friction-enhancing material fixedly mounted on an upper surface of the second deck section of the mattress support;

(iv) the second deck section corresponds to a leg portion of the mattress support surface;

(v) the mattress support surface further comprises a third deck support section pivotally attached to the second deck support section a fourth deck support section pivotally attached to the third deck support section, and (vi) deck support sections of the mattress support corresponding to a head portion of the mattress support surface are free from friction-enhancing materials disposed thereon.

12. The adjustable bed of claim 1, further comprising:

(d) a first mattress friction-enhancing material fixedly mounted on the outer bottom surface of the mattress and positioned in a complementary position relative to the first deck friction-enhancing material and in contact therewith;

wherein the first deck friction-enhancing material and the first mattress friction-enhancing material have an increased coefficient of static friction ($p_s$) at a contact interface between the first deck friction-enhancing material and the first mattress friction-enhancing material relative to a corresponding coefficient of static friction between the upper surface of the mattress support surface and the outer bottom surface of the mattress.

13. The adjustable bed of claim 12, wherein the first mattress friction-enhancing material laterally extends a substantial portion of the mattress width.

14. The adjustable bed of claim 13, wherein the first mattress friction-enhancing material laterally extends at least 40% of the mattress width.

15. The adjustable bed of claim 12, wherein the first mattress friction-enhancing material has a diamond-shaped orientation relative to a longitudinal direction of the adjustable bed.

16. The adjustable bed of claim 12, wherein the coefficient of static friction ($\mu_s$) at the contact interface between the first deck friction-enhancing material and the first mattress friction-enhancing material is at least 0.5.

17. The adjustable bed of claim 12, wherein the first mattress friction-enhancing material comprises a polymer material selected from the group consisting of a thermoset elastomer and a thermoplastic elastomer.

18. The adjustable bed of claim 1, wherein the adjustable bed is free from mattress retainer bars.

19. The adjustable bed of claim 1, wherein the mattress support surface further comprises (iii) a third deck support section pivotally attached to the second deck support section, and (iv) optionally a fourth deck support section pivotally attached to the third deck support section.

20. A method for adjusting an adjustable bed, the method comprising:

(a) providing the adjustable bed of claim 1; and (b) articulating the adjustable bed from a first position to a second position, wherein:

(i) the mattress support surface in the second position is other than a flat configuration; and (ii) the mattress remains substantially in contact with the mattress support surface in the first position and the second position.

21. An adjustable foundation comprising:

(a) a mattress support surface comprising (i) a first deck support section, and (ii) a second deck support section pivotally attached to the first deck support section; and (b) a first deck friction-enhancing material fixedly mounted on an upper surface of the mattress support surface and positioned to contact an outer bottom surface of a mattress positioned above the mattress support surface, when the mattress is present;

wherein the first deck friction-enhancing material and the outer bottom surface of the mattress, when the mattress is present, have an increased coefficient of static friction ($\mu_s$) at a contact interface between therebetween relative to a corresponding coefficient of static friction between the upper surface of the mattress support surface and the outer bottom surface of the mattress, when the mattress is present.

* * * * *